US006213227B1

(12) United States Patent
Dietzen

(10) Patent No.: US 6,213,227 B1
(45) Date of Patent: Apr. 10, 2001

(54) OIL AND GAS WELL CUTTINGS DISPOSAL SYSTEM WITH CONTINOUS VACUUM OPERATION FOR SEQUENTIALLY FILLING DISPOSAL TANKS

(75) Inventor: Gary H. Dietzen, Lafayette, LA (US)

(73) Assignee: M-I, L.L.C., Houston, TX (US)

( * ) Notice: Subject to any disclaimer, the term of this patent is extended or adjusted under 35 U.S.C. 154(b) by 0 days.

(21) Appl. No.: 09/476,503

(22) Filed: Jan. 3, 2000

Related U.S. Application Data

(63) Continuation-in-part of application No. 08/950,296, filed on Oct. 14, 1997, now Pat. No. 6,009,959, which is a continuation-in-part of application No. 08/813,462, filed on Mar. 10, 1997, now Pat. No. 5,839,521, which is a continuation-in-part of application No. 08/729,872, filed on Oct. 15, 1996, now Pat. No. 5,842,529, which is a continuation-in-part of application No. 08/416,181, filed on Apr. 4, 1995, now Pat. No. 5,564,509, which is a continuation-in-part of application No. 08/197,727, filed on Feb. 17, 1994, now Pat. No. 5,402,857.

(51) Int. Cl.[7] ..... E21B 21/06; B09B 5/00

(52) U.S. Cl. ..... 175/66; 175/206; 175/207

(58) Field of Search ..... 175/66, 206, 207, 175/88; 134/108

(56) References Cited

U.S. PATENT DOCUMENTS

| | | | |
|---|---|---|---|
| D. 296,027 | 5/1988 | Dietzen | D34/39 |
| D. 337,809 | 7/1993 | Dietzen | D23/202 |
| 1,125,413 | 1/1915 | Van Doren . | |

(List continued on next page.)

FOREIGN PATENT DOCUMENTS

| | | |
|---|---|---|
| 0 005 273 | 5/1979 | (EP) . |
| 2162880A | 2/1986 | (GB) . |

OTHER PUBLICATIONS

Max–Vac Rentals, *Vacuum Skid Unit,* Spec Sheet (with Pictures on Back).
Dresser Industries, Inc., Specifications—*Roots Vacuum Boosters* (Frames 406DVJ Thru 1220DVJ), Feb., 1988.
Dresser Industries, Inc., *Roots DVJ Dry Vacuum Whispair® Blowers*, Nov., 1991.
Dresser Industries, Inc., Specifications—*Roots DVJ Whispair® Dry Vacuum Pumps* (Frames 1016J, 1220J and Larger), Dec., 1992.
Chicago Conveyor Corporation *Pneumatic Conveying Systems and Specialties,* Brochure.

*Primary Examiner*—Frank Tsay
(74) *Attorney, Agent, or Firm*—Howrey Simon Arnold & White, LLP

(57) ABSTRACT

A method and apparatus of removing drill cuttings from an oil and gas well drilling platform includes the steps of separating the drill cuttings from the well drilling fluid on the drilling platform so that the drilling fluids can be recycled into the well bore during drilling operations. The cuttings are then transmitted via gravity flow to a materials trough having an interior defined by sidewalls and a bottom portion. The drill cuttings are suctioned from the bottom portion of the trough interior with a suction line having an intake portion that is positioned at the materials trough bottom. Drill cuttings are transmitted via the suction line to a pair of hoppers that each have an interior chamber. A vacuum is formed in sequence within the interior chamber of each hopper using a vacuum means that is in fluid communication with the hopper interior chambers. The two hoppers are positioned one above the other so that cuttings can be added to the first, upper hopper via the suction line and then fed by gravity to the second, lower hopper. A valving arrangement maintains vacuum within the interior chamber of at least one hopper at all times. The lower hopper discharges onto a shaker where drilling fluids are separated from drill cuttings. The separated drilling fluids are then saved in a storage tank for recycling into the well bore during drilling operations. The separated drill cuttings are then discharged into a holding tank for storage and transportation.

19 Claims, 12 Drawing Sheets

U.S. PATENT DOCUMENTS

| | | | |
|---|---|---|---|
| 2,803,501 | 8/1957 | Kelly | 302/17 |
| 3,400,819 | 9/1968 | Burdyn | 175/66 |
| 3,433,312 | 3/1969 | Burdyn et al. | 175/66 |
| 3,993,359 | 11/1976 | Sweeney | 302/15 |
| 4,019,641 | 4/1977 | Merz | 214/14 |
| 4,030,558 | 6/1977 | Morris | 175/266 X |
| 4,565,086 | 1/1986 | Orr, Jr. | 73/23 |
| 4,595,422 | 6/1986 | Hill et al. | 175/206 X |
| 4,793,423 | 12/1988 | Knol | 175/66 |
| 4,878,576 | 11/1989 | Dietzen | 198/494 |
| 4,942,929 | 7/1990 | Malachosky et al. | 175/66 |
| 5,016,717 | 5/1991 | Simons et al. | 175/66 |
| 5,109,933 | 5/1992 | Jackson | 175/66 |
| 5,190,085 | 3/1993 | Dietzen | 141/98 |
| 5,322,393 | 6/1994 | Lundquist | 406/38 |
| 5,341,856 | 8/1994 | Appenzeller | 141/67 |
| 5,344,570 | 9/1994 | McLachlan et al. | 175/66 |
| 5,402,857 | 4/1995 | Dietzen | 175/66 |
| 5,964,304 * | 10/1999 | Morrison, Jr. et al. | 175/38 |

* cited by examiner

OIL AND GAS WELL CUTTINGS DISPOSAL SYSTEM WITH CONTINOUS VACUUM OPERATION FOR SEQUENTIALLY FILLING DISPOSAL TANKS

This is a continuation-in-part of U.S. patent application Ser. No. 08/950,296, filed Oct. 14, 1997, now U.S. Pat. No. 6,009,959 which is a continuation-in-part of U.S. patent application Ser. No. 08/813,462, filed Mar. 10, 1997 (now U.S. Pat. No. 5,839,521), which is a continuation-in-part of U.S. patent application Ser. No. 08/729,872, filed Oct. 15, 1996 (now U.S. Pat. No. 5,842,529), which is a continuation-in-part of U.S. patent application Ser. No. 08/416,181, filed Apr. 4, 1995 (now U.S. Pat. No. 5,564, 509), which is a continuation-in-part of U.S. patent application Ser. No. 08/197,727, filed Feb. 17, 1994 (now U.S. Pat. No. 5,402,857), each of which is incorporated herein by reference.

BACKGROUND OF THE INVENTION

In the drilling of oil and gas wells, a drill bit is used to dig thousands of feet into the crust of the earth. Oilrigs typically employ a derrick that extends above the well drilling platform and that can support joints of drill pipe connected end to end during the drilling operation. As the drill bit is pushed into the earth, additional pipe joints are added to the "string" of drill pipes. The drill string pipes each have an internal, longitudinally extending bore for carrying fluid drilling mud from the well drilling platform to a drill bit supported at the lower or distal end of the drill string.

Drilling mud lubricates the drill bit and carries away well cuttings generated by the drill bit. The cuttings are carried in a return flow stream of drilling mud through the well annulus and back to the well drilling platform at the earth surface. When the drilling mud reaches the surface, it is contaminated with small pieces of shale and rock known as well cuttings or drill cuttings.

In the past, well cuttings have been separated from the reusable drilling mud with commercially available separators that are known as "shale shakers." Some shale shakers are designed to filter coarse material from the drilling mud while other shale shakers are designed to remove finer particles from the well drilling mud. After separating well cuttings, the drilling mud is returned to a mud pit where it can be supplemented and/or treated prior to transmission back into the well bore via the drill string to repeat the process.

The disposal of the separated shale and cuttings is a complex environmental problem. Drill cuttings contain not only the mud product, which would contaminate the surrounding environment, but also can contain environmentally hazardous oil, especially when drilling in a marine environment.

In the Gulf of Mexico for example, there are hundreds of drilling platforms that drill for oil and gas by drilling into the sea floor. These drilling platforms can be in many hundreds of feet of water. In such a marine environment, the water is typically crystal clear and filled with marine life that cannot tolerate the disposal of drill cuttings waste containing a combination of shale, drilling mud, and oil. Therefore, there is a need for a simple, yet workable solution to the problem of disposing of oil and gas well cuttings in offshore marine and other fragile environments. Traditional methods of cuttings disposal have been dumping, bucket transport, cumbersome conveyor belts, and washing techniques that require large amounts of water. Adding water creates additional problems of added volume and transport problems. Installing conveyors requires major modification to the rig area and involves many installation hours and very high cost.

SUMMARY OF THE INVENTION

The present invention provides an improved method and apparatus for removing drill cuttings from an oil and gas well drilling platform that uses a drill bit supported with an elongated, hollow drill string. Well drilling fluid (typically referred to as drilling mud) travels through the drill string to the drill bit during a digging of a well bore.

The method first includes the step of separating well drilling fluid from the drill cuttings on the drilling platform so that the drilling fluid can be recycled into the well bore during drilling operations. The drill cuttings fall via gravity from solid separators (e.g. shale shakers) into a materials trough. At the materials trough, cuttings are suctioned with an elongated suction line having an intake portion positioned in the materials trough to intake well cuttings as they accumulate.

Each suction line has an intake end that is positioned to suction cuttings from the materials trough. Each suction line communicates with a cuttings collection tank. A third tank (i.e. a vacuum tank) is positioned in between the vacuum means and the two collection tanks that communicate with the two materials collection lines. The third tank has dual inlets, each receiving a flow line from a respective collection tank. Each inlet is valved so that either one of the collection tanks can be shut off from the vacuum means. In this fashion, one collection tank can be filled at a time. The two collection tanks can be sequentially filled without having to shut the vacuum source down.

The drill cuttings are transmitted via a selected one of the suction lines to a selected one of the collection tanks.

A vacuum is formed within the selected collection tank interior using a vacuum means that is in fluid communication with the tank interior.

Liquids (drilling mud residue) and solids (well cuttings) are separated from the vacuum line at the selected collection tank before the liquids and solids can enter the vacuum means.

The vacuum means is powered with an electric motor drive to reach a vacuum of between about 16 and 25 inches of mercury. Each vacuum line is sized to generate speeds of between about 100 and 300 feet per second.

In one embodiment, two hoppers are positioned one above the other so that cuttings can be added to the first upper hopper via the suction line that communicates with the trough and then fed by gravity to the second lower hopper. A valving arrangement maintains vacuum within the interior chamber of at least one hopper at all times. The lower hopper discharges onto a shaker where drilling fluids are separated from drill cuttings. The separated drilling fluids are then saved in a storage tank for recycling into the well bore during drilling operations. The separated drill cuttings are then discharged into a holding tank for storage and transportation.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DESCRIPTION OF ILLUSTRATIVE EMBODIMENTS

The present invention relates to the disposal of oil and gas well cuttings generated during the drilling of an oil and gas well using a drill bit connected to an elongated drill string comprised of a number of pipe sections connected together, wherein a fluid drilling mud carries well cuttings away from the drill bit and upwardly to the well head through a well annulus and to a solids removal area at the well head for separating well cuttings from the drilling mud. Even more particularly, the present invention relates to an improved well cuttings disposal system that collects oil and gas well cuttings in a transportable tank that is subjected to a vacuum and in which collection chambers alternatively and sequentially receive cuttings and separate drilling mud from the cuttings for recycling, and wherein a continuous feed hopper and valve arrangement enables continuous vacuum operation.

Figure 1:
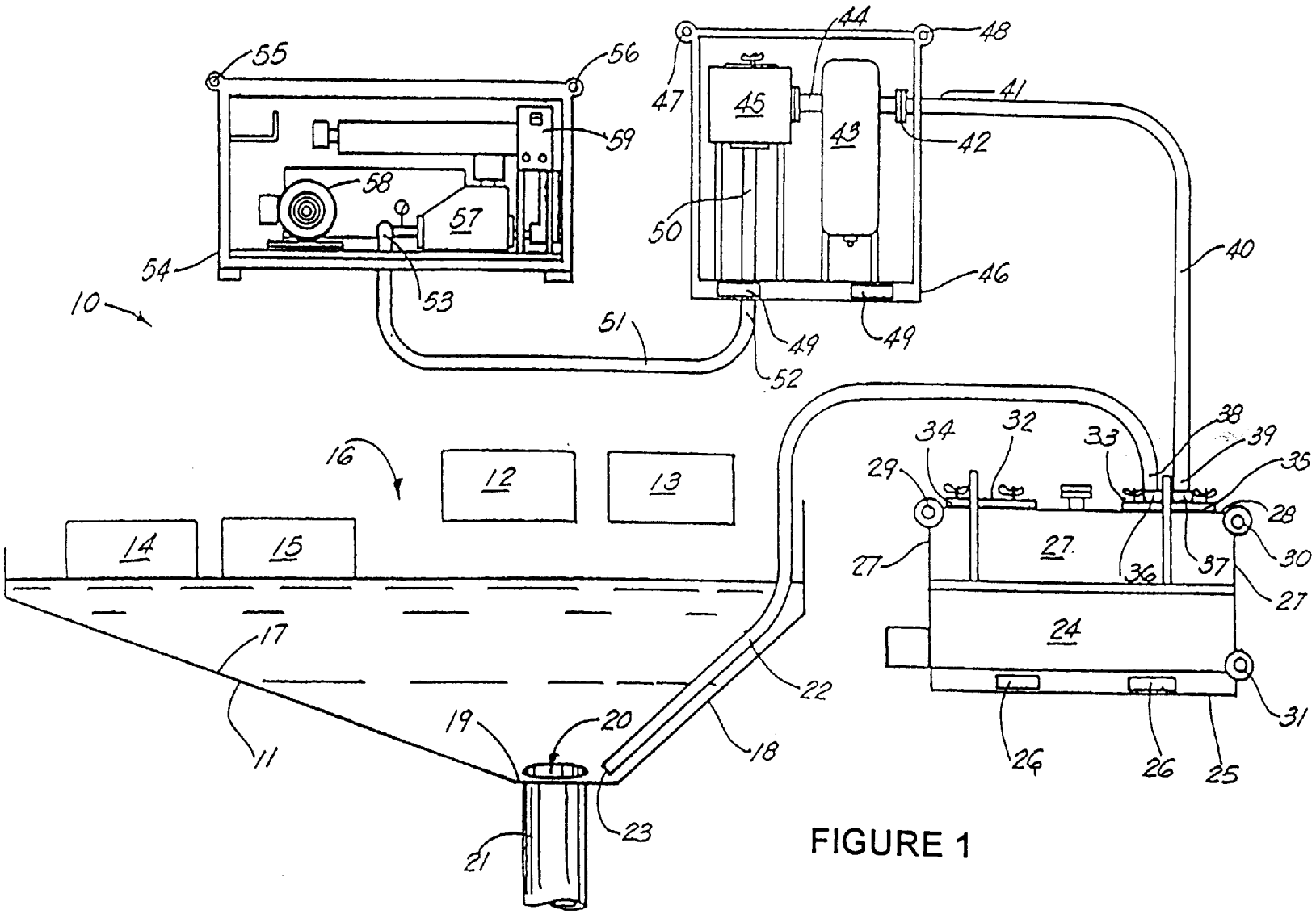
FIG. 1 is a schematic view of the first embodiment of the apparatus of the present invention.

In FIG. 1, there can be seen a first embodiment of the well cuttings disposal system 10 of the present invention. Well cuttings disposal system 10 is used in combination with a materials trough that collects solids falling via gravity from a plurality of solids separator units. Materials troughs per se are known in the art, typically as a catch basin for cuttings. The materials trough 11 defines an area that is a receptacle for drill cuttings containing some residual drilling mud. The cuttings have been collected from the well bore after the drilling mud has been transmitted through the drill string to the drill bit and then back to the surface via the well annulus.

At the material trough, there are a plurality of coarse shakers 12, 13 and a plurality of fine shakers 14, 15. The shakers 12, 13, and 14, 15 are commercially available. Coarse shakers 12, 13 are manufactured under and sold under the mark "BRANDT" and fine shakers are sold under the mark "DERRICK." Shakers 12–15 channel away the desirable drilling mud to a mud pit. The well cuttings fall via gravity into trough 11. It is known in the prior art to channel away drilling mud that is to be recycled, and to allow well cuttings to fall from shale shakers via gravity into a receptacle. Such as been the case on oil and gas well drilling rigs for many years.

Interior 16 of trough 11 catches cuttings that have fallen from shakers 12, 15. The trough 11 thus defines an interior 16 having a plurality of inclined walls 17, 18 that communicate with a trough bottom 19. Walls 17, 18 can be Teflon covered to enhance travel of material to bottom 19.

Trough bottom 19 includes a discharge opening 20 that communicates with discharge conduit 21. The opening 20 is typically sealed during operation with a closure plate (not shown).

A first suction line 22 is positioned to communicate with the interior 16 portion of trough 11. First suction line 22 thus provides an inlet 23 end portion and an opposite end portion 38 that communicates with collection tank 24. Tank 24 collects solid material and some liquid (e.g., residual drilling mud on the cuttings) as will be described more fully.

Collection tank 24 has a bottom 25, a plurality of generally rectangular sidewalls 27, and a generally rectangular top 28. Forklift sockets 26 allow tank 24 to be lifted and transported about the rig floor and to a position adjacent a crane or other lifting device. Openings 32, 33 in the top of tank 24 are sealable using hatches 34, 35 respectively.

A plurality of lifting eyes 29, 30, and 31 are provided including eyes 29, 30 on the top of tank 24 and lifting eye 31 on the side thereof near bottom 25.

The lifting eyes 29 and 30 are horizontally positioned at end portions of the tank top 28. This allows the tank to be lifted with a crane, spreader bar, or other lifting means for transferal between a marine vessel and the drilling rig platform. In FIG. 1, the tank 24 is in such a generally horizontal position that is the orientation during use and during transfer between the rig platform and a remote location on shore.

The lifting eyes 30, 31 are used for emptying the tank 24 after it is filled with cuttings. When the tank is to be emptied, a spreader bar and a plurality of lifting lines are used for attachment to lifting eyes 30, 31. This supports the tank in a position that places lifting eye 29 and lifting eye 30 in a vertical line. In this position, the hatch 34 is removed so that the cuttings can be discharged via gravity from opening 32 and into a disposal site.

During a suctioning of well cuttings from materials trough 11, the suction line 22 intakes cuttings at inlet 23. These cuttings travel via line 22 to outlet 38, which communicates with coupling 36 of hatch 35. Flow takes place from inlet 23 to outlet 38 because a vacuum is formed within the hollow interior of tank 24 after hatches 34, 35 are sealed. The vacuum is produced by using second suction line 40 that communicates via separators 43, 45 with third suction line 51 and vacuum means 57.

Second suction line 40 connects at discharge 39 to coupling 37 of hatch 35. The opposite end of suction line 40 connects at end portion 41 via coupling 42 to fine separator 43. A second fine separator 45 is connected to separator 43 at spool piece 44. The two separators 43 and 45 are housed on a structural separator skid 46 that includes lifting eyes 47, 48 and fork lift sockets 49 for transporting the skid 46 in a manner similar to the transport of tank 24 as previously described.

Third suction line 51 connects to effluent line 50 that is the discharge line from separator 45. End portion 52 of third suction line 51 connects to effluent line 50 at a flanged, removable connection, for example. The three suction lines 22, 40, 51 are preferably between 3 and 6 inches in internal diameter, and are coupled with vacuum means 57 generating about 300–1500 cubic feet per minute of air flow, to generate desired flow velocities of about 100–300 feet per second that move the shale cuttings through suction line 22. The suction lines are preferably flexible hoses of oil resistant PVC or can be Teflon coated rubber. Quick connect fittings are used to connect each suction line at its ends.

End portion 53 of third section line 51 also connects via a flanged coupling, for example, to vacuum means 57. Vacuum means 57 and its motor drive 58 are contained on power skid 54. Power skid 54 also includes a control box 59 for activating and deactivating the motor drive 58 and vacuum means 57. The power skid 54 provides a plurality of lifting eyes 55, 56 to allow the power skid 54 to be transported from a work boat or the like to a well drilling platform using a lifting harness and crane that are typically found on such rigs.

Each unit, including tank 24, separator skid 46, and power skid 54, can be lifted from a work boat or the like using a crane and transported to the rig platform deck.

Figure 2:
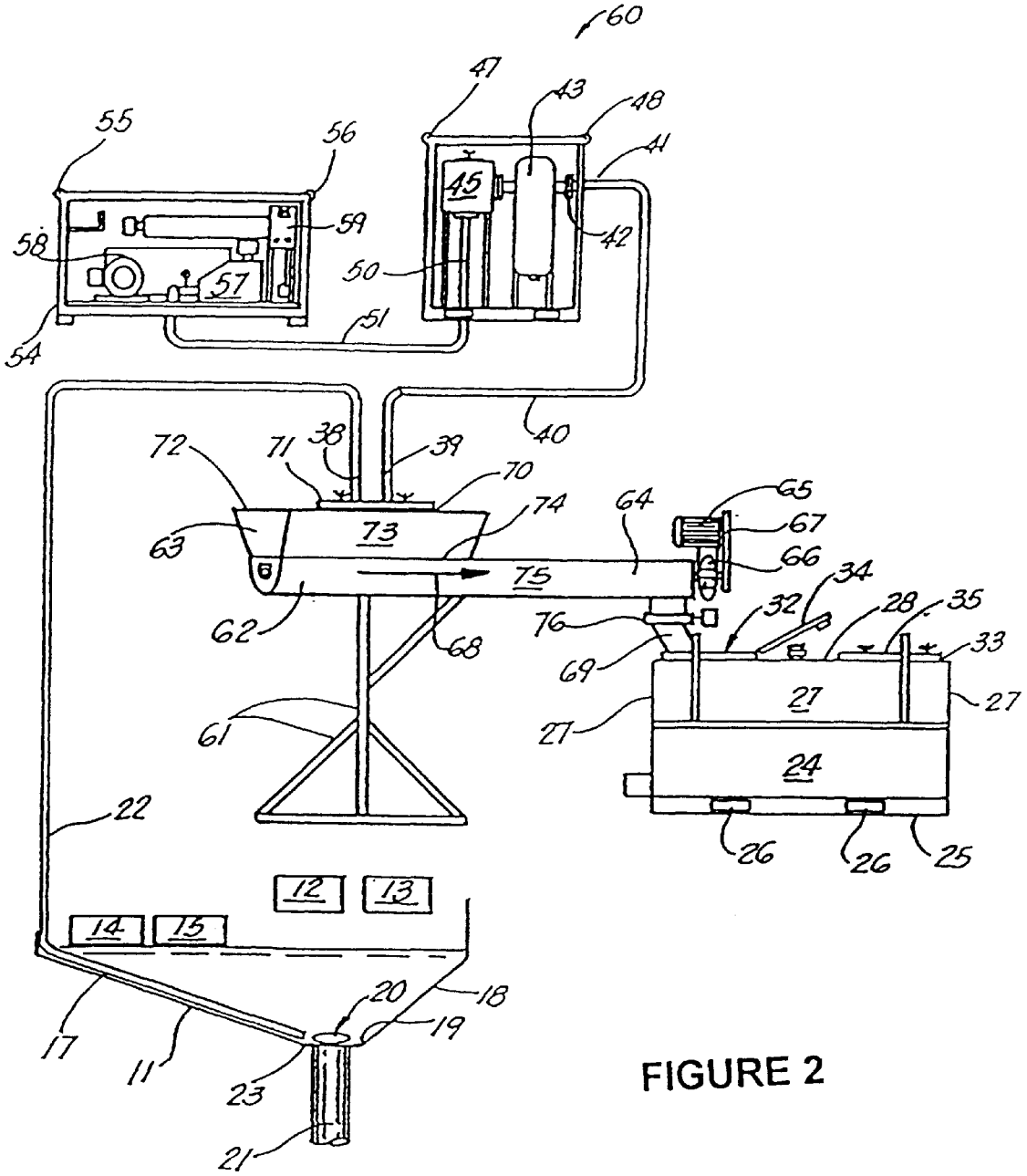
FIG. 2 is a schematic view of a second embodiment of the apparatus of the present invention.

In FIG. 2, a second embodiment of the apparatus of the present invention is disclosed, designated generally by the numeral 60. In FIG. 2, the tank 24 is similarly constructed to that of the preferred embodiment of FIG. 1. However, in FIG. 2, the well cuttings disposal system 60 includes a support 61 that supports a screw conveyor 62 and its associated trough 63. The trough 63 and screw conveyor 62 are sealed at opening 70 in trough 63 using hatch 71. Trough 63 is positioned at an intake end portion of screw conveyor while the opposite end portion of screw conveyor 62 provides a discharged end portion 64 that communicates with discharge shoot 69. Chute 69 empties into opening 32 when hatch 34 is open during use, as shown in FIG. 2.

The screw conveyor 62 is driven by motor drive 65 that can include a reduction gearbox 66 and a drive belt 67. Arrow 68 in FIG. 2 shows the flow path of coarse cuttings that are discharged via first suction lines 22 into opening 70 and trough 63. The sidewall and bottom 74 of trough 63 communicate and form a seal with screw conveyor outer wall 75 so that when a vacuum is applied using second suction line 40, cuttings can be suctioned from trough 11 at intake 23 as with the preferred embodiment. The conveyor 62 forcibly pushes the drill cuttings toward discharge end 64. A spring-activated door 76 is placed in chute 69. When material backs up above door 76, the door quickly opens under the weight of cuttings in chute 69. Once the cuttings pass door 76, the door shuts to maintain the vacuum inside trough 73 and screw conveyor 62, thus enabling continuous vacuuming.

Figure 3:
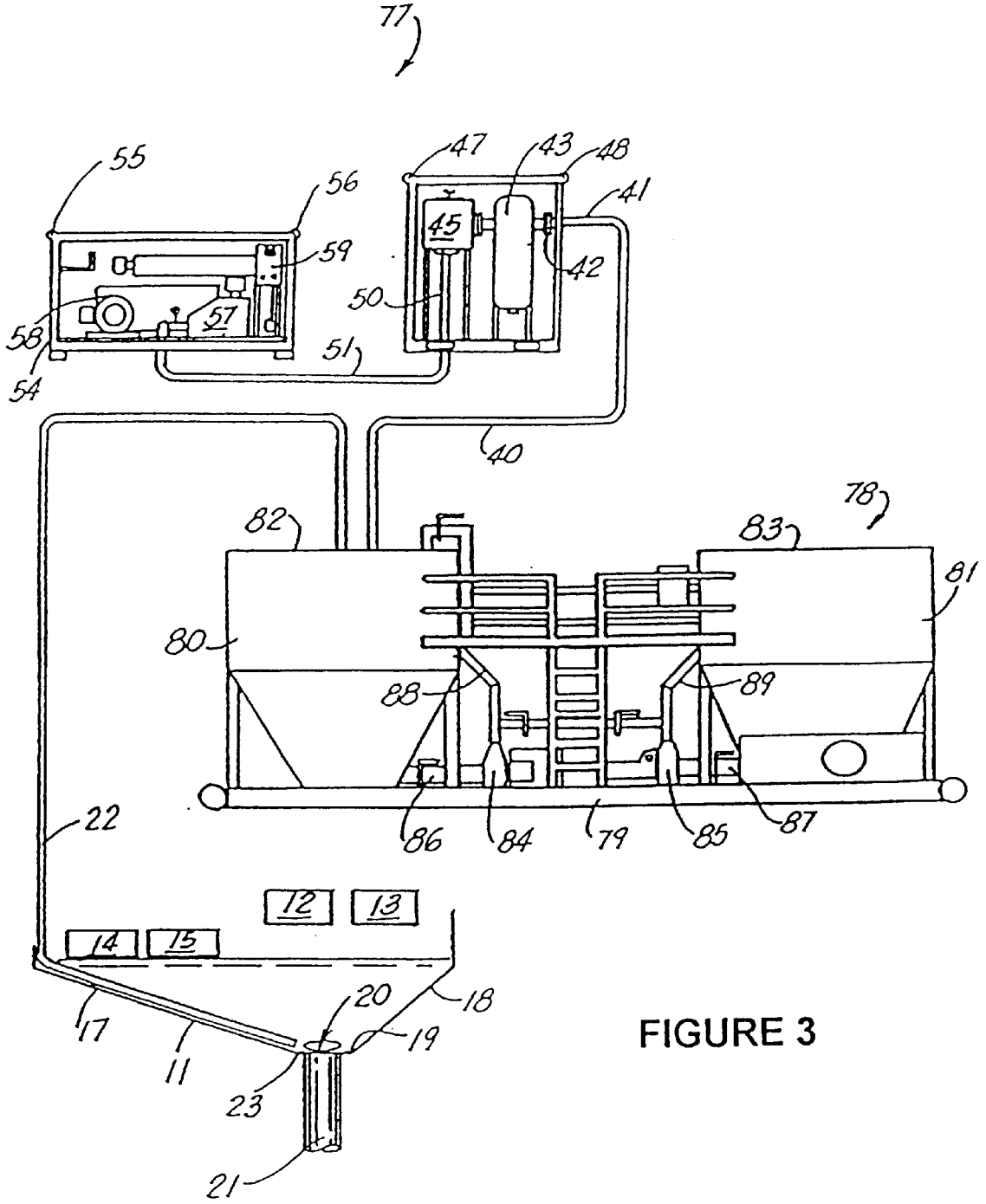
FIG. 3 is a schematic view of a third embodiment of the apparatus of the present invention.

In FIG. 3 there can be seen a third embodiment of the apparatus of the present invention designated generally by the numeral 77. Well disposal cutting system 77 substitutes a slurry unit 78 for collection tank 24 of FIG. 1. Slurry unit 78 has a liftable base frame 79 of welded steel, for example. Upon the frame 79 are positioned a pair of vessels 80, 81. Each vessel 80, 81 has a top into which well cuttings can be suctioned in a manner similar to the way well cuttings are suctioned into collection tank 24 with the embodiment of FIG. 1.

The vessel tops 82, 83 respectively can be provided with openings for connecting the flow lines 22, 40 as with the embodiments of FIGS. 1 and 2. The slurry unit 78 provides pumps 84, 85 with impellers (e.g., Mission Magnum fluid centrifugal pump with 75 hp electric motor—5" discharge, 6" suction) for continuously breaking up the cuttings until they form a slurry with a liquid such as water. Pumps 84, 85 have suction flow lines 86, 87 respectively and discharge lines 88, 89 respectively. The discharge lines 88, 89 communicate with the upper end portion of each of the vessels 80, 81 respectively. Likewise, the suction lines 86, 87 communicate with the lower end portion of each of the vessels 80, 81 respectively.

Using the method and apparatus of FIG. 3, a desired volume of cuttings can be suctioned into either one or both of the vessels 80, 81. The pumps 84, 85 are equipped with impellers that can chop up the cuttings into even finer pieces. For example, the pump impellers can have carbide tips that are effective in chopping up and pulverizing the cuttings until a slurry is formed. Each pump 84, 85 continuously recirculates the slurry of cuttings and water between the pump 84, 85 and its respective vessel 80, 81 until a thick viscous slurry is created. A triplex pump (e.g., Gardner Denver) and piping (not shown) can then be used for transmitting the slurried cuttings from the respective vessels 80, 81 downhole into the well annulus, usually between 2000 and 5000 feet, to a porous zone such as a sand zone. In this fashion, the cuttings are disposed of by deep well disposal at the drill site rather than transporting the cuttings to a remote site such as on shore in the case of a marine based platform.

Figure 4:
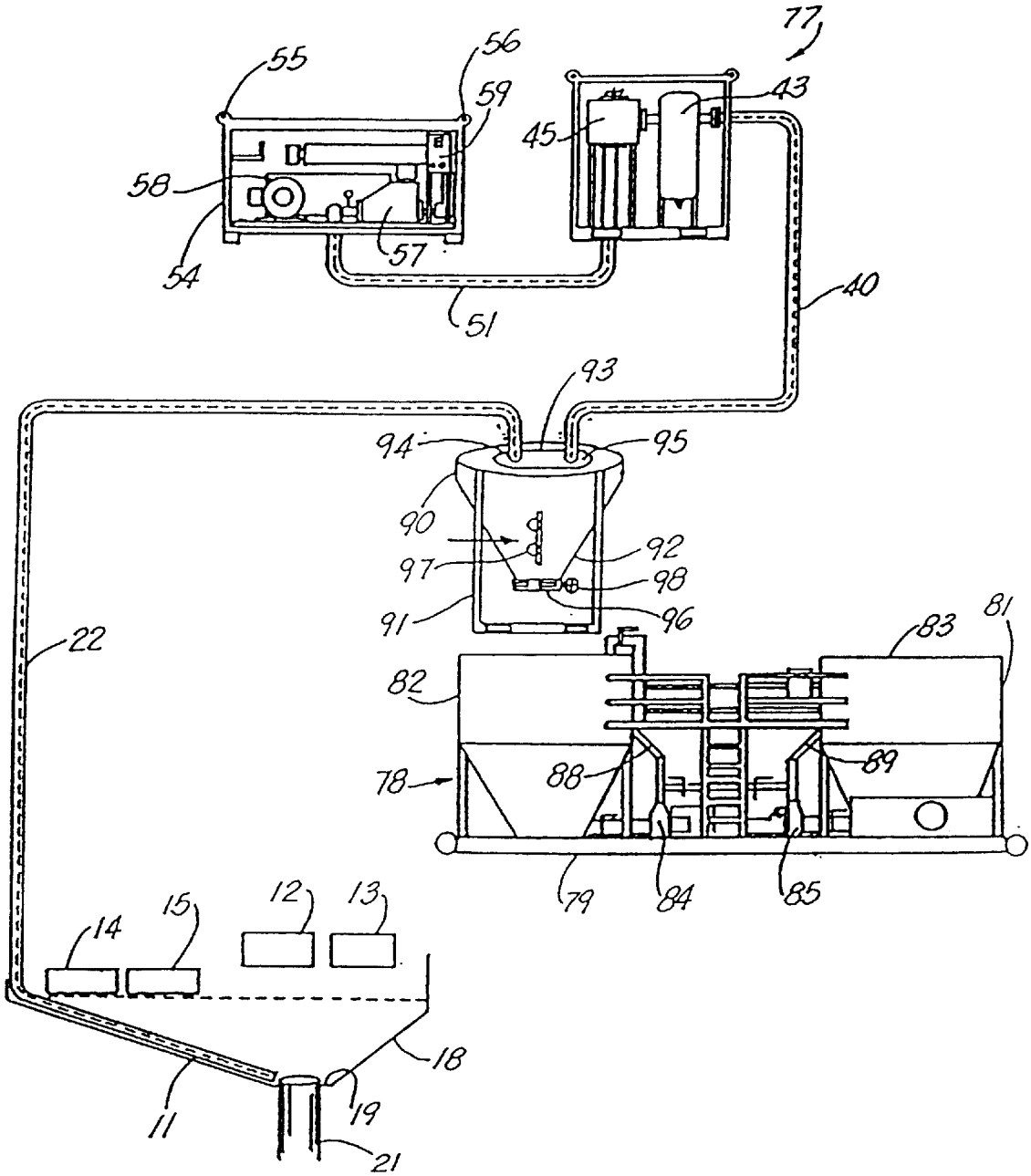
FIG. 4 is a schematic view of the third embodiment of the apparatus of the present invention illustrating the use of a hopper tank in combination with the slurry unit.

In FIG. 4, a hopper tank 90 is shown in combination with the slurry unit 78. Hopper 90 is an optional unit that can be used to receive cuttings from first suction line 22 and to collect the cuttings for batch discharge into slurry unit 78 at intervals. As with the embodiment of FIG. 1, the hopper tank 90 provides a rectangular or circular lid 93 with openings 94, 95 that communicate with vacuum lines 22 and 40 respectively.

Hopper tank 90 is preferably supported with a structural liftable frame 91. The tank 90 has a conical wall 92. The upper end portion of tank 90 provides the circular lid 93 while the lower end portion of tank 90 has a discharge outlet 96 controlled by valve 98. Air vibrators 97 can be attached to the conical wall 92 for insuring a complete and smooth discharge of cuttings from within the interior of the hollow hopper tank 90.

In FIGS. 5–8, the fourth embodiment of the apparatus of the present invention is designated generally by numeral 133. Well cuttings disposal system 133 employs two suction lines 134, 135 in the embodiment of FIGS. 5–8. The two suction lines 134, 135 each provide respective inlet portions 136, 137 for intaking well cuttings and associated material that fall into trough 11. Trough 11 would be constructed in accordance with the description of FIG. 1. Thus, trough 11 can include material separation equipment such as coarse or fine shakers that channel away desirable drilling mud to a mud pit and allow well cuttings fall via gravity, for example, into trough 11.

As with the embodiment of FIG. 1, it is known in prior art to channel away drilling mud that is to be recycled and to allow well cuttings to fall from shale shakers and like separating equipment via gravity into the interior of a receptacle such as trough 11.

Figure 5:
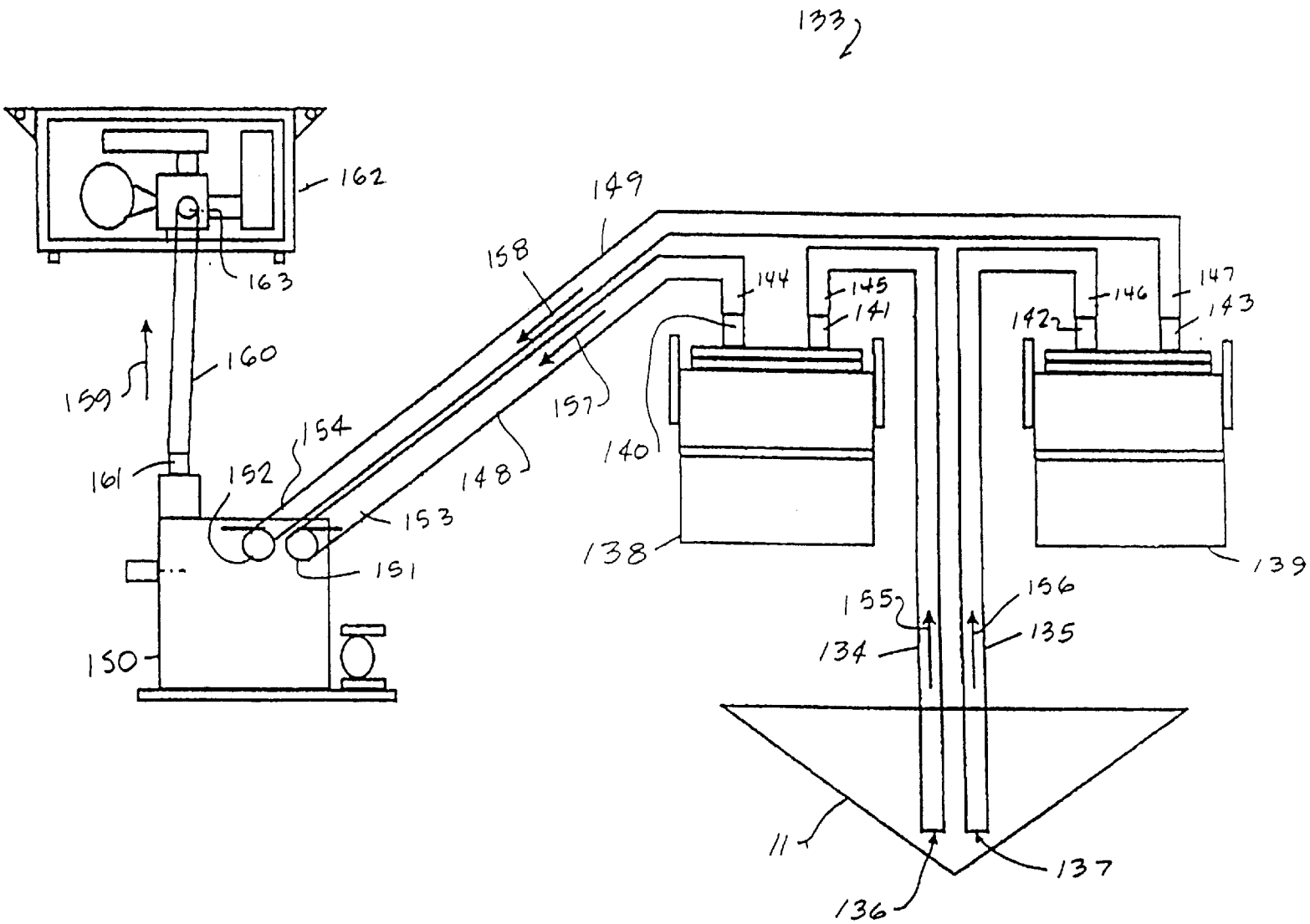
FIG. 5 is a schematic view of a fourth embodiment of the apparatus of the present invention.

In FIG. 5, the inlet portions 136, 137 are positioned in the interior of trough 11 to enable either inlet portion 136 or 137 to vacuum cuttings. The embodiment of FIG. 1 uses a single suction line to remove cuttings from the interior of trough 11, but in FIG. 5, two suction lines are used, each with its own collection tank 138 or 139.

In FIG. 5, each collection tank 138, 139 receives well cuttings suctioned from suction lines 134, 135 respectively. Each collection tank 138, 139 provides fittings for forming connections with end portions of the primary suction lines 134, 135 and with end portions of secondary suction lines 148, 149.

An end portion 145 of suction line 134 forms a connection at inlet fitting 141. Similarly, inlet fitting 142 forms a connection with end portion 146 of primary suction line 135. Secondary suction line 148 forms a connection at its end portion 144 with outlet fitting 140. Similarly, secondary suction line 149 forms a connection at its end portion 147 with outlet fitting 143. The secondary suction lines 148, 149 form connections at their respective end portions 153, 154 with inlet fittings 151, 152 of rig vacuum tank 150.

In FIGS. 5–8, rig vacuum tank 150 provides an outlet fitting 161 for connection of tertiary suction line 160. Line 160 conveys air to vacuum skid 162 as shown by the arrow 159 in FIG. 5. The vacuum skid 162 is constructed in accordance with the embodiment of FIGS. 1–4, including a vacuum means that is powered with an electric motor to reach a vacuum of between 16 and 25 inches of mercury. In FIG. 1, power skid unit 54 includes a control box 59 for activating and deactivating the motor drive 58 and vacuum means 57. Vacuum skid 162 can thus be constructed in accordance with power skid unit 54 in the embodiment of FIG. 1.

During use, the vacuum skid 162 generates a vacuum that communicates with flow line 160 and thus the interior of tank 150. The presence of a vacuum in tank 150 also produces a vacuum in the primary suction lines 134, 135, collection tanks 138, 139, and in the secondary vacuum lines 148, 149. This vacuum produces suction at inlets 136, 137 for transmitting cuttings and like material contained in trough 11 to collection tanks 138, 139 via primary suction lines 134, 135 respectively. This travel of well cuttings and like material from trough 11 to collection tanks 138 and 139 is indicated by the arrows 155, 156 in FIG. 5.

Material traveling from trough 11 to collection tank 138 travels in primary suction line 134 and enters collection tank 138 at inlet fitting 141. The collection tank 138 communicates with its outlet fitting 140 with secondary suction line 148 and inlet fitting 151 of vacuum tank 150. When tank 138 fills, some material may flow in the direction of arrow 157 from tank 138 into vacuum tank 150. However, the vacuum tank 150 has a level sensor 172 that shuts off vacuum skid 162 should the level of material in tank 150 reach the sensor 172 which is positioned at a level just below inlets 151, 152. In this fashion, neither liquid nor solid material can reach vacuum skid 162.

In practice, the collection tanks 138, 139 are filled in an alternating, sequential fashion. This is made possible by valves 151A, 152A that are placed at fittings 151, 152 respectively. The operator simply closes the valve at fitting 152 when the valve at 151 is open and tank 138 is being filled. This closure of valve 152A shuts off any vacuum from secondary flow line 149 and primary flow line 135 to tank 139. Thus, tank 138 preliminarily fills until the valve 152A at fitting 152 is opened and the valve 151A at fitting 151 is closed.

In this manner, an operator can continuously suction cuttings from trough 11. This is important when well drilling activity is at a peak and the trough 11 is receiving a continuous flow of cuttings from shale shakers and like equipment. By alternating the vacuum to tank 138 or tank 139, the well cuttings disposal system 133 of the present invention can function continuously. When a tank 138 or 139 is filled, suctioning switches to the other tank so that the filled tank 138 or 139 can be removed and a new tank can be put in its place. If fluid or other material in tank 150 reaches sensor 172, the vacuum skid 162 can be automatically shut off. However, the sensor 172 can also operate a diaphragm discharge pump 174 for emptying the contents of vacuum tank 150.

Figure 6:
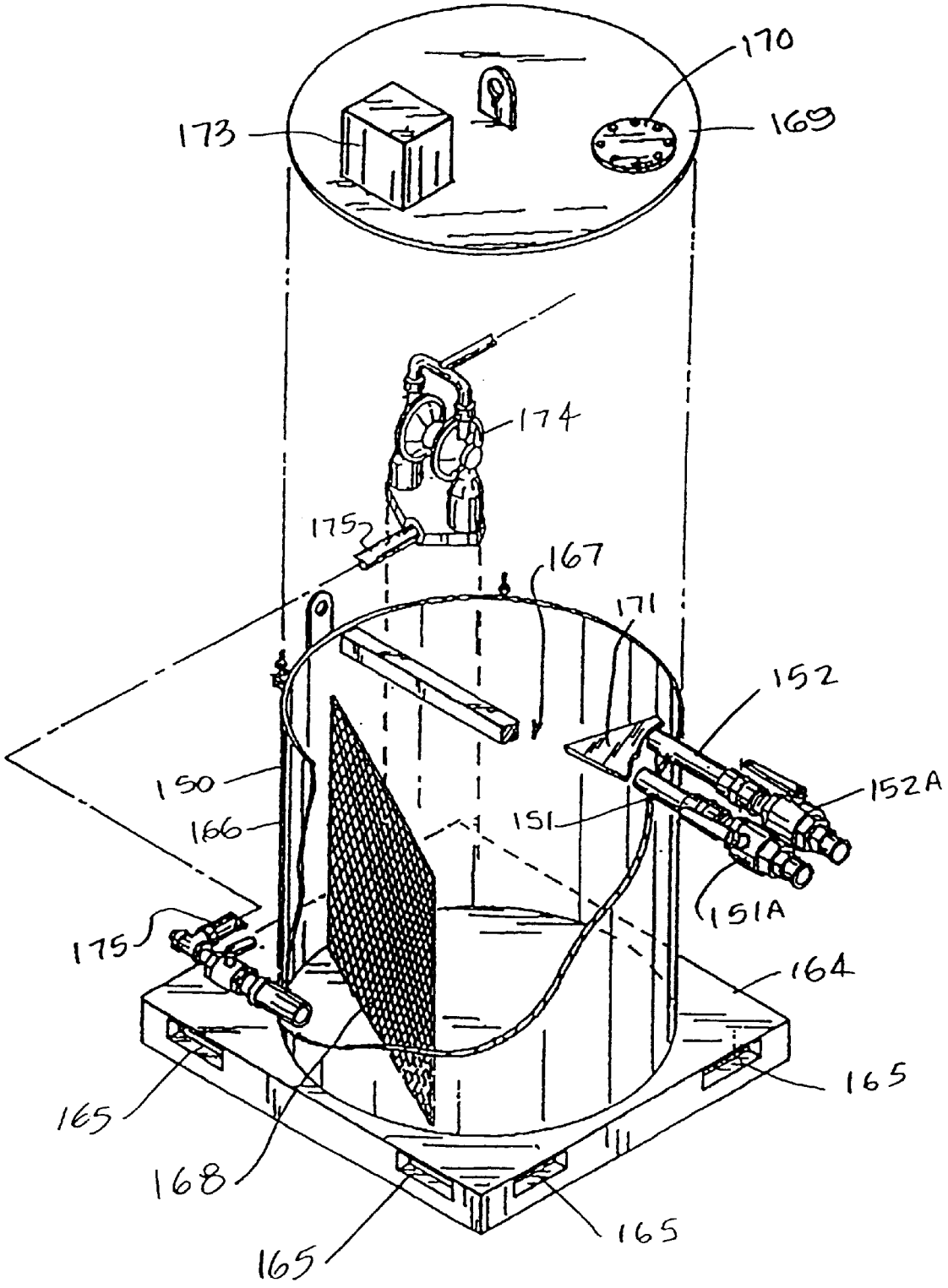
FIG. 6 is a fragmentary perspective view of the fourth embodiment of the apparatus of the present invention illustrating the rig vacuum tank portion.
Figure 8:
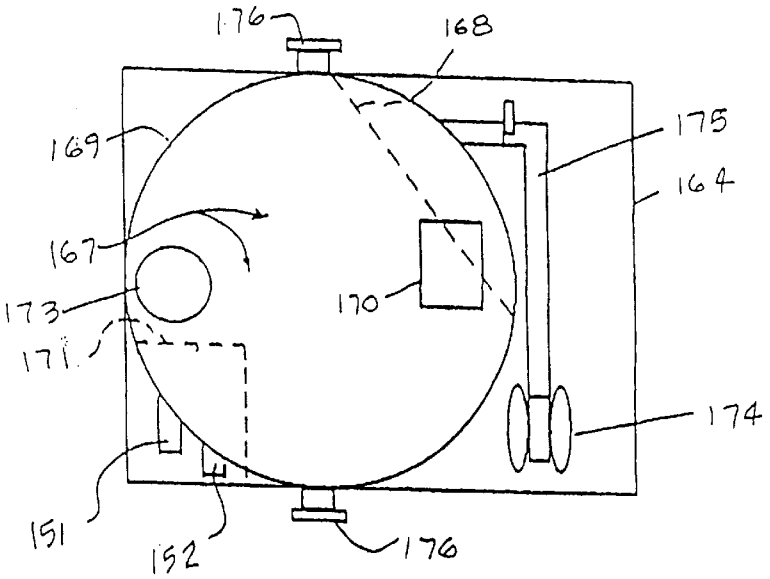
FIG. 8 is a top fragmentary view of the fourth embodiment of the apparatus of the present invention illustrating the rig vacuum tank portion.
Figure 7:
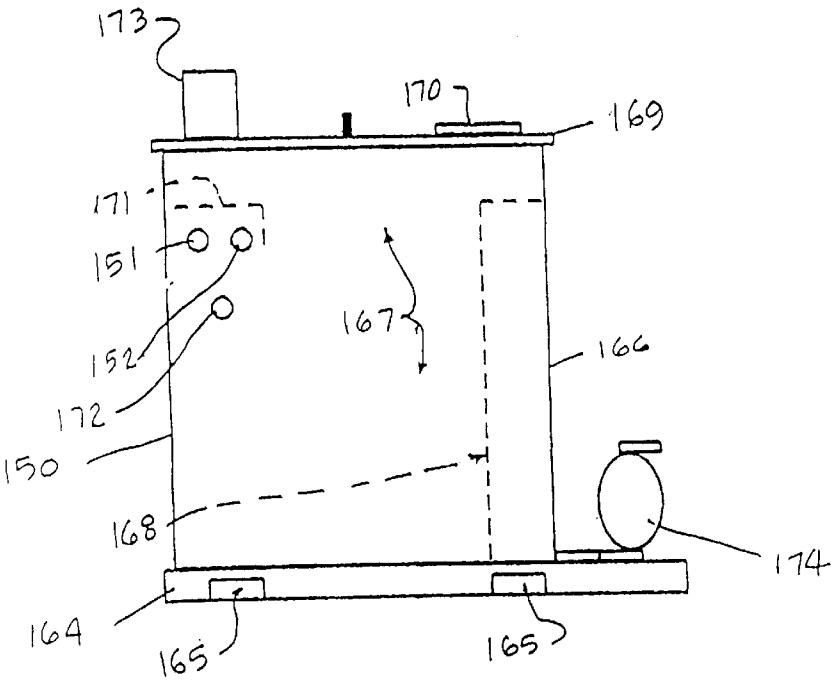
FIG. 7 is a fragmentary side, elevational view of the fourth embodiment of the apparatus of the present invention illustrating the rig vacuum tank portion.

FIGS. 6–8 show more particularly the construction of rig vacuum tank 150. Tank 150 has a base 164 with a pair of sockets 165 for receiving forklift tines that can lift and transport tank 150. The tank 150 has a cylindrical wall 166 with a hollow tank interior 167. Screen 168 is placed on the inside 167 of tank 150 and functions to prevent debris from getting into diaphragm discharge pump 174. Tank 150 has a removable lid 169 that carries an inspection hatch 170 and a separator 173. The entire lid 169 is removable for easy cleaning of tank 150 should such cleaning be required.

Separator 173 removes any fluids in the air stream that flows through lines 160 to vacuum skid 162. Deflector plate 171 is positioned on the inside 167 of tank 150 for deflecting material that enters tank interior 167 via inlet fittings 151, 152. Discharge pump 174 communicates with tank interior via flow line 175.

Figure 9:
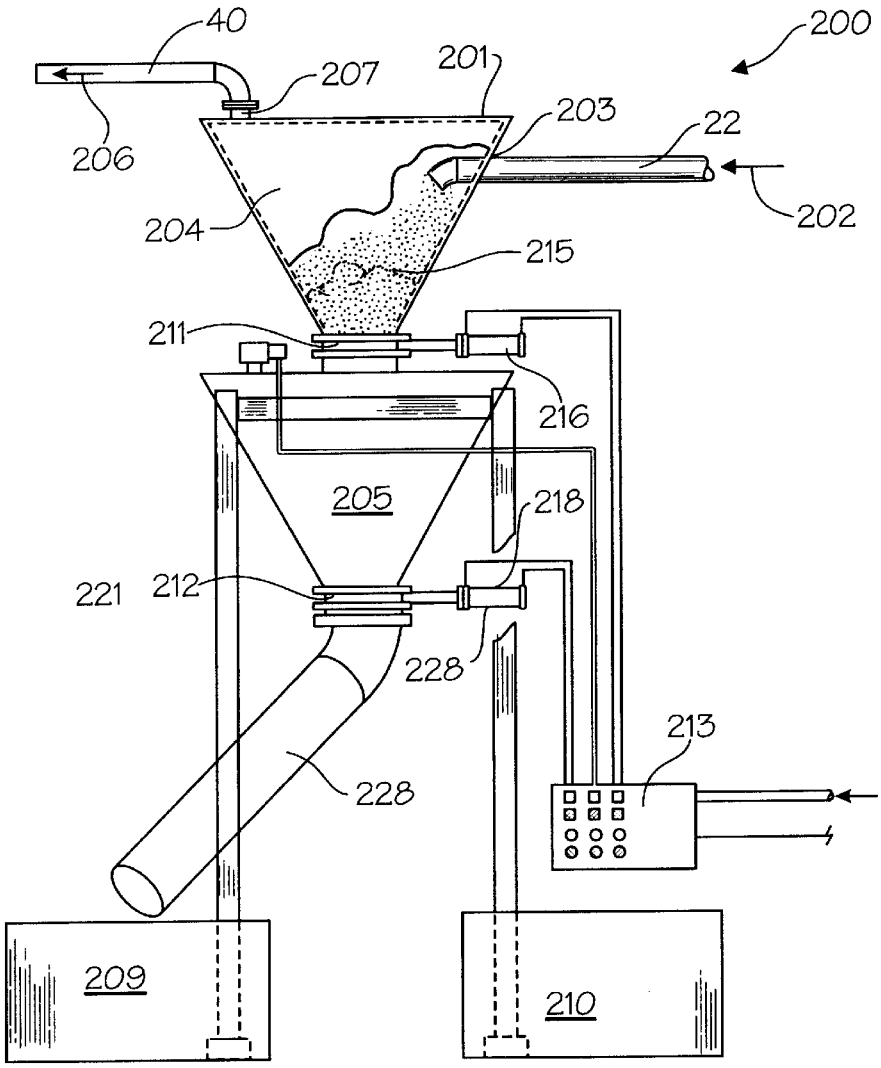
FIG. 9 is a perspective view of a fifth embodiment of the apparatus of the present invention.
Figure 10:
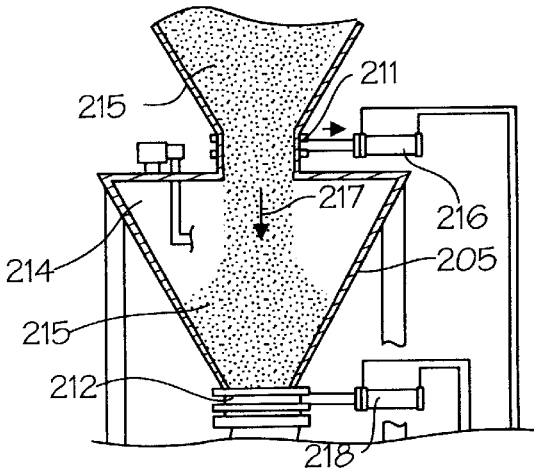
FIGS. 10–12 are fragmentary elevational views of the fifth embodiment of the apparatus of the present invention showing the hoppers and valving member portions.

FIGS. 9–13 show a fifth embodiment of the apparatus of the present invention designated generally by the numeral 200. The embodiment of the FIGS. 9 and 10 is similar in overall layout to the embodiment of FIG. 1. The difference is that instead of the collection tank 24 of FIG. 1, the first suction line 22 communicates with an upper hopper 201 so that cuttings flowing in the first suction line 22 enter hopper 201 at inlet 203. Arrow 202 in FIG. 9 indicates the flow direction of the cuttings. Upper hopper 201 is also positioned above a lower hopper 205. Thus, the embodiment of FIGS. 9 and 10 represents a double hopper 201, 205 arrangement that replaces the tank 24 of FIG. 1. The upper hopper interior chamber 204 is subjected to a vacuum applied by vacuum means 57 and second suction line 40 and arrow 206 in FIG. 9 indicates the direction of the air flow. Outlet fitting 207 can be used to form a connection between upper hopper 201 and second suction line 40 as shown in FIG. 9.

As shown in FIGS. 9 and 10, a valving arrangement is used to control the flow of cuttings between upper hopper 201 and lower hopper 205. Similarly, this valving arrangement controls the flow of cuttings from the lower hopper 205 to discharge conduit 208 and then to holding tanks 209, 210. The holding or collection tanks 209, 210 can be constructed as shown in FIGS. 1 and 2 with respect to tank 24. During use, multiple holding tanks 209, 210 can be used for collecting cuttings that are discharged by conduit 209 from lower hopper 205. A user controls the valve members 211, 212 using a control panel 213 and pneumatic or hydraulic controllers (commercially available) to direct flow from holding tank 209 that has become filled to holding tank 210 that is empty, Valves 211, 212 can be pneumatic actuated flex-gate knife valves, for example, manufactured by Red Valve Company, Inc. of Pittsburgh, Pa., USA.

As will be described more fully below, the upper valve 211 is initially closed so that suction lines 22, 40 begin filling upper hopper 201 (FIG. 9). As the interior chamber 204 of upper hopper 201 becomes almost filled, valve operator 216 opens valve 211 while lower valve 212 remains closed (FIG. 10). In FIG. 10, both hoppers 201 and 205 are subjected to a vacuum. However, the vacuum does not prevent cuttings 215 collected in upper hopper interior chamber 204 from falling through upper valve 211 and into the interior chamber 214 of lower hopper 205. This transfer of cuttings from upper hopper 201 to lower hopper 205 is shown in FIG. 10. Closure of lower valve 212 maintains the vacuum on interior chambers 204 and 214 of both hoppers 201 and 205. Otherwise, if valve 212 were opened the vacuum would be lost.

Figure 11:
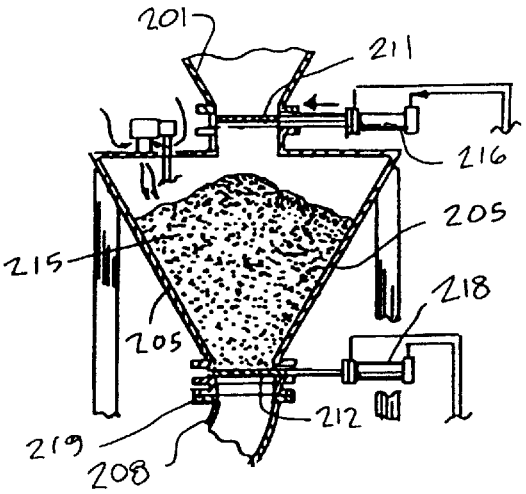
Figure 12:
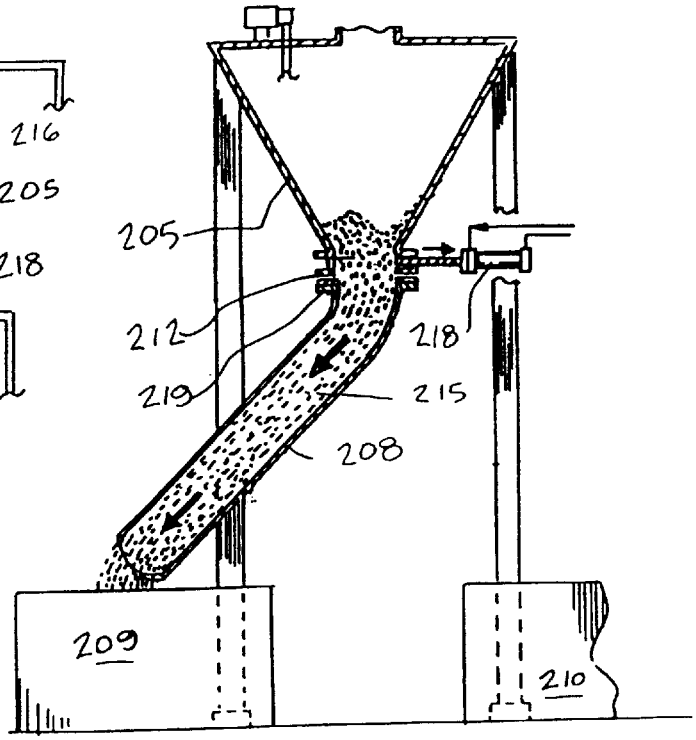
Figure 13:
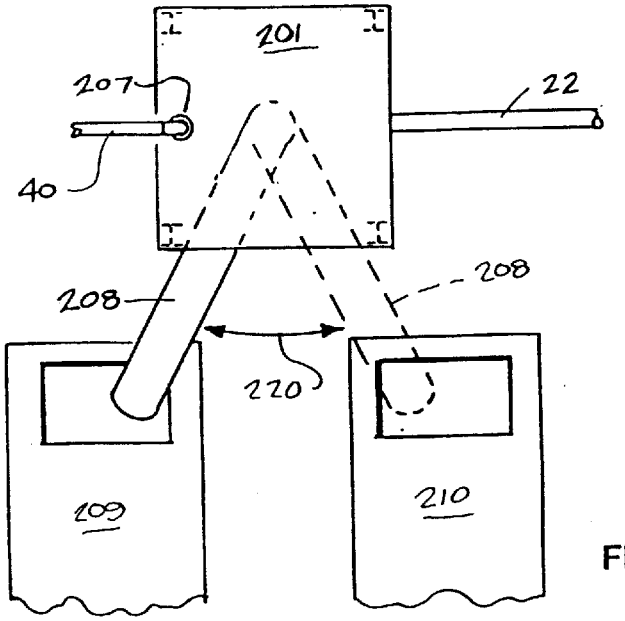
FIG. 13 is a top fragmentary view of the fifth embodiment of the apparatus of the present invention showing the chute movement when filling the two holding tanks.

Holding tank 209 cannot receive cuttings 215 when lower valve 212 is closed as shown in FIG. 10. Once the contents of upper hopper 201 have been emptied to the lower hopper 205, valve operator 216 closes valve 211 (FIG. 11). With the vacuum preserved within interior chamber 204 of hopper 201 (FIG. 11), valve operator 218 then is opens valve 212 (FIG. 12). Opening valve 212 discharges the contents (cuttings 215) within the interior chamber 214 of lower hopper 205 into conduit chute 208 and then into the selected cuttings disposal tank 209, 210 (FIG. 12). Conduit chute 208 can be rotated at rotary coupling 219 from one holding tank 209 to the other holding tank 210 and then back to tank 209 as each tank 209, 210 is filled, emptied, and then placed back under conduit chute 208 as shown by arrow 220 in FIG. 13.

Figure 14:
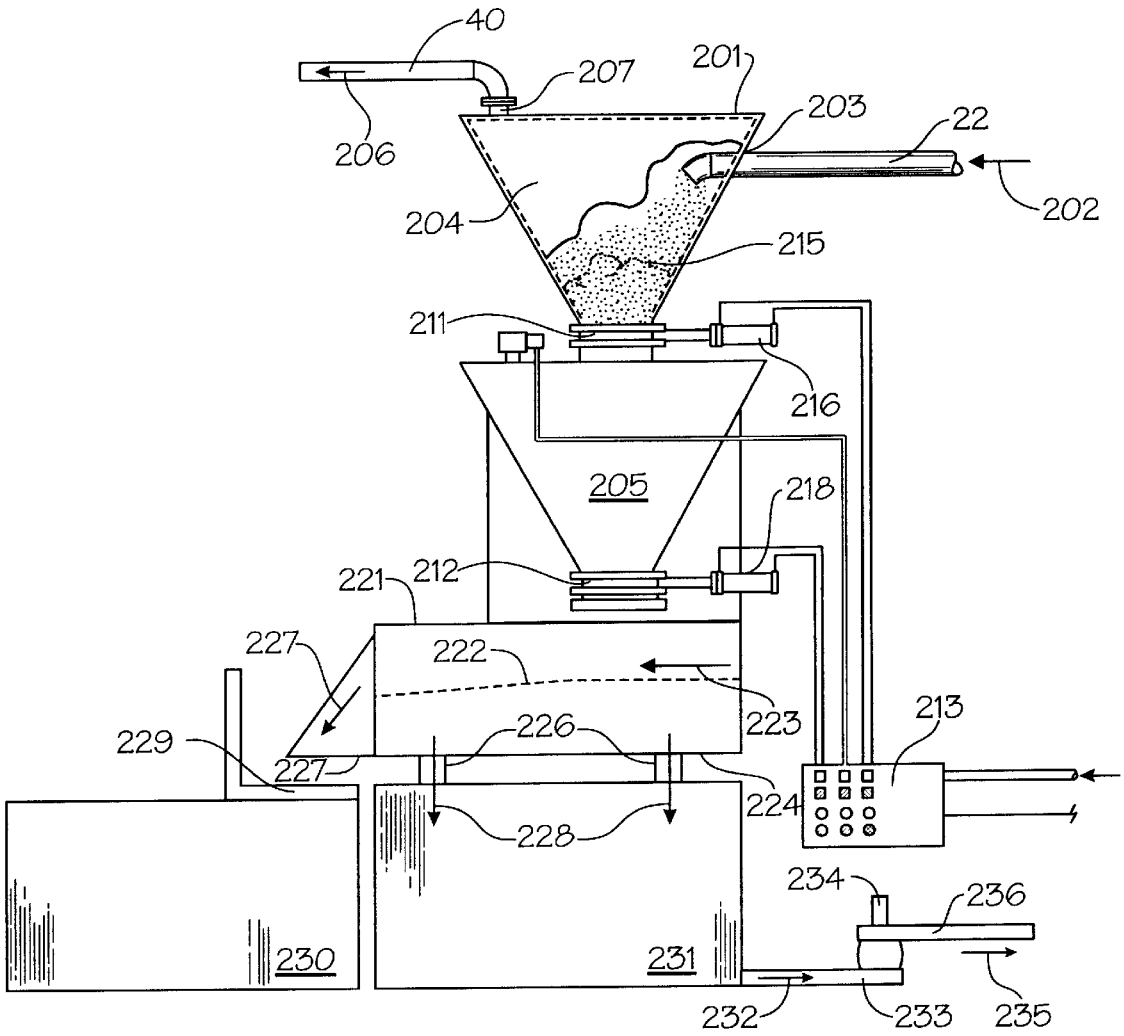
FIG. 14 is perspective view of a sixth embodiment of the apparatus of the present invention.
Figure 15:
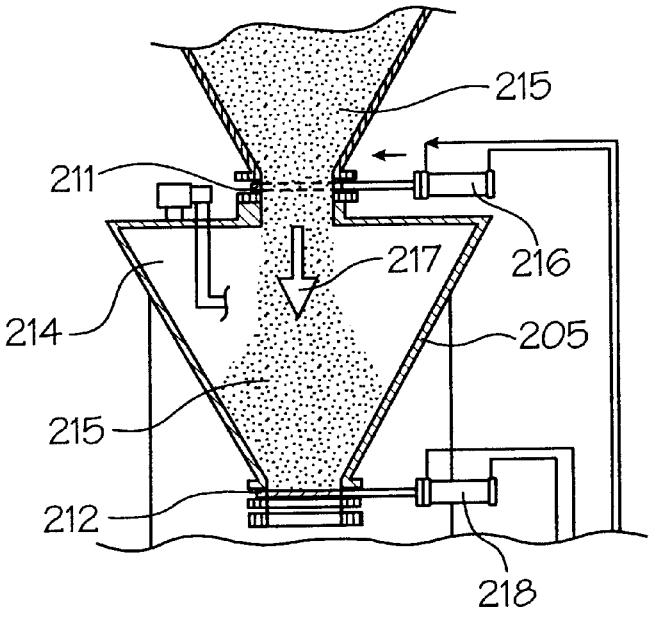
FIGS. 15–17 are fragmentary elevational views of the sixth embodiment of the apparatus of the present invention showing the hoppers and valving member portions.

FIGS. 14–17 show a sixth embodiment of the apparatus of the present invention designated generally by the numeral 300. The embodiment of FIGS. 14 and 15 is similar in overall layout to the embodiment of FIG. 1. The difference is that instead of the collection tank 24 of FIG. 1, the first suction line 22 communicates with an upper hopper 201 so that cuttings flowing in the first suction line 22 enter hopper 201 at inlet 203. Arrow 202 in FIG. 14 indicates the flow direction of the cuttings. The upper hopper interior chamber 204 is subjected to a vacuum applied by vacuum means 57 and second suction line 40. Arrow 206 in FIG. 9 indicates the direction of the air flow. Outlet fitting 207 can be used to form a connection between upper hopper 201 and second suction line 40 as shown in FIG. 14. Upper hopper 201 is also positioned above a lower hopper 205. Thus, the embodiment of FIGS. 9 and 10 represents a double hopper 201, 205 arrangement that replaces the tank 24 of FIG. 1.

As shown in FIGS. 14 and 15, a valving arrangement is used to control the flow of cuttings between upper hopper 201 and lower hopper 205. Similarly, this valving arrangement controls the flow of cuttings from the lower hopper 205 to a shaker 221 and then to cuttings storage tank 230. The holding or collection tank 230 can be constructed as shown in FIGS. 1 and 2 with respect to tank 24. A user controls valves 211, 212 using a control panel 213 and pneumatic or hydraulic controllers (commercially available) to direct flow of cuttings to shaker 221. Valves 211, 212 can be pneumatic actuated flex-gate knife valves, for example, manufactured by Red Valve Company, Inc. of Pittsburgh, Pa., USA.

As will be described more fully below, the upper valve 211 is initially closed (FIG. 14) so that suction lines 22, 40 begin filling upper hopper 201 (FIG. 14). As the interior chamber 204 of upper hopper 201 becomes almost filled, valve operator 216 opens valve 211 while lower valve 212 remains closed (FIG. 15). In FIG. 15, both hoppers 201 and 205 are subjected to a vacuum. However, the vacuum does not prevent cuttings 215 collected in upper hopper 201 from falling through upper valve 211 and into the interior chamber 214 of lower hopper 205. This transfer of cuttings from upper hopper 201 to lower hopper 205 is shown in FIG. 15. Closure of lower valve 212 maintains the vacuum on the interior chambers 204 and 214 of both hoppers 201 and 205. Otherwise, if valve 212 were opened the vacuum would be lost.

Figure 16:
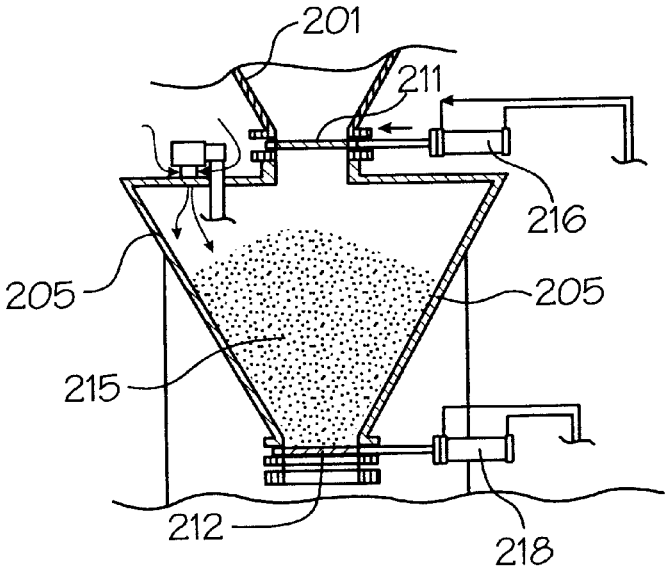
Figure 17:
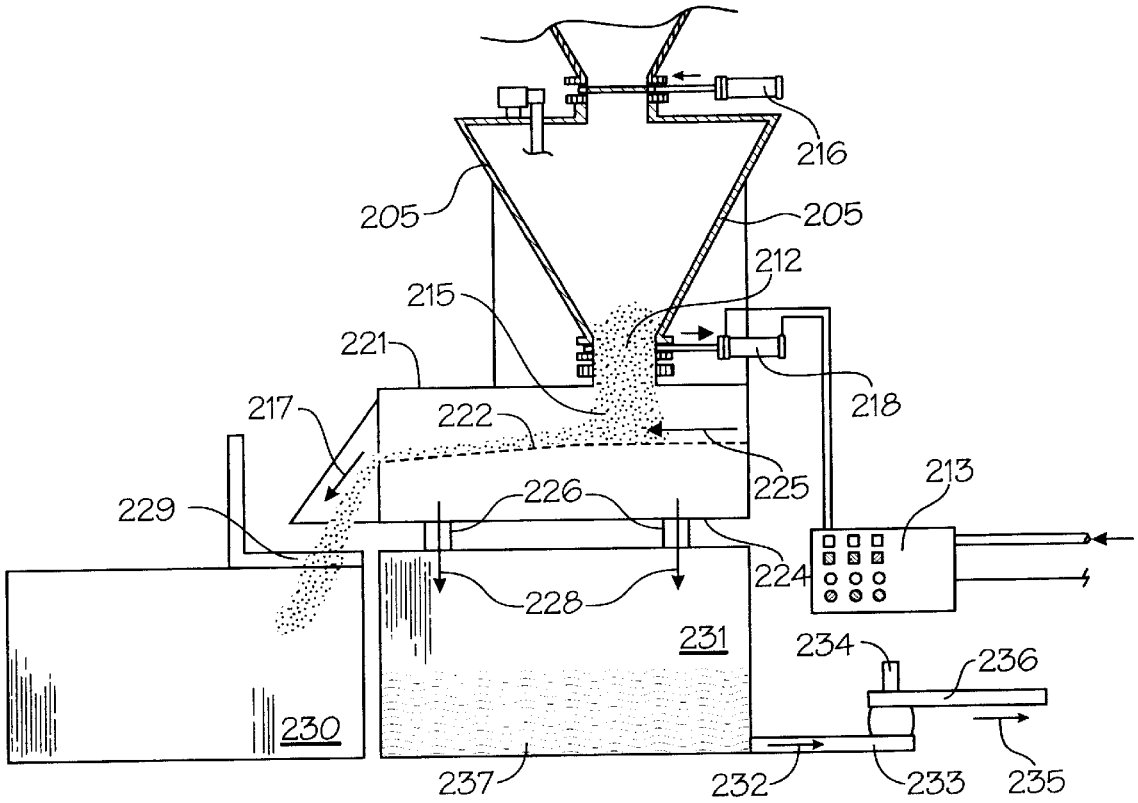

Shaker 221 cannot receive cuttings 215 when the lower valve 212 is closed as shown in FIG. 15. Once the contents of upper hopper 201 have been emptied to the lower hopper 205, valve operator 216 closes valve 211 (FIG. 16). With the vacuum preserved within interior chamber 204 of hopper 201, valve operator 218 then opens valve 212 (FIG. 17). Opening valve 212 discharges the contents (cuttings 215) within the interior chamber 214 of lower hopper 205 onto a shaker 221 (FIG. 17).

Shaker 221 has a vibrating shaker screen 222 that separates the contents of lower hopper 205 into cuttings 215 and drilling fluids 237. Drilling fluids 237 fall through vibrating shaker screen 222 into recycled drilling fluids trough 224 (FIG. 17). Drilling fluids 237 then drain from recycled drilling fluids trough 224 through drilling fluids discharge openings 226 into a drilling fluids storage tank 231. Arrows 228 in FIG. 17 show the flow direction of drilling fluids 237 as they drain from recycled drilling fluids trough 224.

Cuttinos 215 travel across the vibrating shaker screen 222 in the direction of arrow 225. Cuttings 215 then discharge into holding tank 230 for storage and transportation. Arrow 217 indicates the discharge direction of drill cuttings 215 as they are discharged into holding tank 230.

From the drilling fluids storage tank 231, drilling fluids pump 234 pumps drilling fluids 237 through a drilling fluids line 233 in the direction of arrow 232 (FIG. 17). Pump 234 then pumps drilling fluids 237 through drilling fluids discharge line 236 in the direction of arrow 235. Drilling fluids 237 are then recycled into the well bore during drilling operations. The following table lists the parts numbers and parts descriptions as used herein and in the drawings attached hereto.

PARTS LIST

| Part Number | Description |
|---|---|
| 10 | well cuttings disposal system |
| 11 | materials trough |
| 12 | coarse shaker |
| 13 | coarse shaker |
| 14 | fine shaker |
| 15 | fine shaker |
| 16 | reservoir |
| 17 | inclined wall |
| 18 | inclined wall |
| 19 | trough bottom |
| 20 | discharge opening |
| 21 | conduit |
| 22 | first suction line |
| 23 | inlet |
| 24 | collection tank |
| 25 | bottom |
| 26 | fork lift socket |
| 27 | side wall |
| 28 | top |
| 29 | lifting eye |
| 30 | lifting eye |
| 31 | lifting eye |
| 32 | opening |
| 33 | opening |
| 34 | hatch |
| 35 | hatch |
| 36 | coupling |
| 37 | coupling |
| 38 | outlet |
| 39 | discharge |
| 40 | second suction line |
| 41 | end |
| 42 | coupling |
| 43 | separator |
| 44 | spool piece |
| 45 | separator |
| 46 | separator skid |
| 47 | lifting eye |
| 48 | lifting eye |

-continued

PARTS LIST

| Part Number | Description |
|---|---|
| 49 | fork lift socket |
| 50 | effluent line |
| 51 | third suction line |
| 52 | end |
| 53 | end |
| 54 | power skid |
| 55 | lifting eye |
| 56 | lifting eye |
| 57 | vacuum means |
| 58 | motor drive |
| 59 | control box |
| 60 | well cuttings disposal system |
| 61 | support |
| 62 | screw conveyor |
| 63 | trough |
| 64 | discharge end portion |
| 65 | motor drive |
| 66 | gearbox |
| 67 | drive belt |
| 68 | arrow |
| 69 | discharge chute |
| 70 | opening |
| 71 | hatch |
| 72 | top |
| 73 | side wall |
| 74 | bottom |
| 75 | screw conveyor outer wall |
| 76 | spring loaded door |
| 77 | well cuttings disposal unit |
| 78 | slurry unit |
| 79 | frame |
| 80 | vessel |
| 81 | vessel |
| 82 | top |
| 83 | top |
| 84 | pump |
| 85 | pump |
| 86 | flow line |
| 87 | flow line |
| 88 | flow line |
| 89 | flow line |
| 90 | hopper tank |
| 91 | liftable frame |
| 92 | conical wall |
| 93 | circular lid |
| 94 | opening |
| 95 | opening |
| 96 | outlet |
| 97 | air vibrator |
| 98 | valve |
| 133 | well cuttings disposal system |
| 134 | primary suction line |
| 135 | primary suction line |
| 136 | inlet portion |
| 137 | inlet portion |
| 138 | collection tank |
| 139 | collection tank |
| 140 | outlet fitting |
| 141 | inlet fitting |
| 142 | inlet fitting |
| 143 | outlet fitting |
| 144 | end portion |
| 145 | end portion |
| 146 | end portion |
| 147 | end portion |
| 148 | secondary suction line |
| 149 | secondary suction line |
| 150 | rig vacuum tank |
| 151 | inlet |
| 151A | valve |
| 152 | inlet |
| 152A | valve |
| 153 | end portion |
| 154 | end portion |
| 155 | arrow |

-continued

PARTS LIST

| Part Number | Description |
|---|---|
| 156 | arrow |
| 157 | arrow |
| 158 | arrow |
| 159 | arrow |
| 160 | flow line |
| 161 | outlet fitting |
| 162 | vacuum skid |
| 163 | inlet fitting |
| 164 | base |
| 165 | socket |
| 166 | cylindrical wall |
| 167 | tank interior |
| 168 | screen |
| 169 | lid |
| 170 | inspection hatch |
| 171 | deflector plate |
| 172 | fluid level sensor |
| 173 | separator |
| 174 | discharge pump |
| 175 | flow line |
| 176 | lifting eye |
| 200 | continuous feed well cuttings disposal system |
| 201 | upper hopper |
| 202 | arrow |
| 203 | inlet fitting |
| 204 | interior chamber |
| 205 | lower hopper |
| 206 | arrow |
| 207 | outlet fitting |
| 208 | discharge conduit |
| 209 | holding tank |
| 210 | holding tank |
| 211 | valving member |
| 212 | valving member |
| 213 | control panel |
| 214 | interior chamber |
| 215 | cuttings |
| 216 | operator |
| 217 | arrow |
| 218 | operator |
| 219 | rotary coupling |
| 220 | arrow |
| 300 | continuous feed well cuttings disposal system |
| 221 | drill cuttings shaker |
| 222 | vibrating shaker screen |
| 223 | arrow |
| 224 | recycled drilling fluids trough |
| 225 | drill cuttings discharge opening |
| 226 | drilling fluids discharge opening |
| 227 | arrow |
| 228 | arrow |
| 229 | cuttings storage tank opening |
| 230 | cuttings storage tank |
| 231 | drilling fluids storage tank |
| 232 | arrow |
| 233 | drilling fluids line |
| 234 | drilling fluids pump |
| 235 | arrow |
| 236 | drilling fluids discharge line |
| 237 | drilling fluids |

Because varying and different embodiments may be made within the scope of the inventive concept taught, and because modifications may be made in the embodiments detailed in accordance with the descriptive requirement of the law, it is to be understood that the disclosed details are to be interpreted as illustrative and not in a limiting sense.

What is claimed is:

1. A method of removing drill cuttings from a well drilling platform during the drilling of a well bore using a drill bit supported by a drill string in combination with a drilling fluid comprising:

a) separating drill cuttings from the well drilling fluid on the drilling platform so that the separated drilling fluids can be recycled into the well bore during drilling operations;

b) moving the separated cuttings to a materials trough having an interior adapted for collecting the separated cuttings;

c) forming a vacuum within a suction line and an upper hopper with vacuum means that are in fluid communication with the suction line and the upper hopper;

d) suctioning the separated drill cuttings with the suction line, the suction line having an intake end portion positioned at the materials trough;

e) transmitting the drill cuttings via the suction line to the upper hopper, the upper hopper having an interior chamber, at least one access opening and at least one discharge opening for communicating with the interior chamber, and means for controlling the flow of material from the interior chamber through the discharge opening;

f) discharging the drill cuttings from the upper hopper through the upper hopper discharge opening to a lower hopper, the lower hopper having an interior chamber, at least one access opening and at least one discharge opening for communicating with the interior chamber, and means for controlling the flow of material from the discharge chamber through the discharge opening;

g) discharging the drill cuttings from the lower hopper through the lower hopper discharge opening onto a shaker, the shaker having a vibrating shaker screen, a drill cuttings discharge opening, and a fluids container below the vibrating shaker screen, the fluids container having at least one drilling fluids discharge opening;

h) separating drilling fluids from the drill cuttings as the cuttings pass over the vibrating shaker screen by having the drilling fluids pass through the shaker screen and into the fluids container;

i) discharging the separated drilling fluids from the fluids container via the fluids container discharge opening into a drilling fluids holding tank so that the drilling fluids can be recycled into the well bore during drilling operations; and j) discharging the separated drill cuttings via the shaker drill cuttings discharge opening into a holding tank.

2. The method of claim 1 wherein the flow velocity in the suction line is about 100 to 300 feet per second.

3. The method of claim 1 further comprising controlling flow through the discharge openings of the upper and lower hopper with a valving member.

4. The method of claim 1 wherein liquids and solids are separated from the suction line at the upper hopper.

5. The method of claim 1 wherein said vacuum means comprises a blower and an electric motor drive for powering the blower.

6. The method of claim 5 wherein the blower generates fluid flow in the vacuum lines of between about 300 and 1500 cubic feet per minute.

7. The method of claim 1 wherein the vacuum formed within the hopper is between about 16 and 25 inches of mercury.

8. The method of claim 1 wherein the upper hopper is positioned vertically above the lower hopper so that cuttings can flow via gravity from the upper hopper to the lower hopper.

9. The method of claim 1 wherein the vibrating shaker screen in positioned vertically above the fluids container so that the drilling fluids fall via gravity from the vibrating shaker screen to the fluids container.

10. The method of claim 1 further comprising using the upper and lower hopper discharge opening valves to maintain a vacuum within the upper hopper when cuttings flow via gravity to the lower hopper or from the lower hopper to the shaker.

11. An oil well drill cuttings disposal apparatus comprising:

a) an upper and a lower hopper for collecting drill cuttings to be disposed of, each of the hoppers having an interior chamber, an inlet opening that allows material to be added to each hopper, and a discharge outlet that enables the hopper interior chamber to be emptied;

b) a suction line for transmitting cuttings from a drill site to the inlet opening of the upper hopper;

c) a vacuum means for forming a vacuum within the hopper interior chambers;

d) a second suction line having one end portion in fluid communication with the upper hopper interior chamber and another end portion in fluid communication with the vacuum source;

e) a means for controlling flow of cuttings from the upper and lower hopper discharge openings;

f) a shaker for separating drill cuttings from drilling fluids, the shaker comprising a vibrating shaker screen, a cuttings discharge opening, and a drilling fluids container located beneath the vibrating shaker screen, the drilling fluids container having at least one discharge opening;

g) a storage tank for receiving separated drilling fluids from the shaker drilling fluids container, the storage tank having an interior, at least one inlet opening that allows drilling fluids to be added to the storage tank, and a discharge opening;

h) a holding tank for receiving cuttings from the shaker, the holding tank having an interior and an inlet opening that allows drilling fluids to be added to the storage tank; and i) a pump in fluid communication with the storage tank discharge opening for pumping the separated drilling fluids into the well bore during drilling operations.

12. The apparatus of claim 11 wherein the suction line includes a flexible hose.

13. The apparatus of claim 11 wherein the means for controlling discharge of cuttings from the upper and lower hopper discharge openings consists of sealing valves.

14. The apparatus of claim 13 wherein the valves enable a user to discharge well cuttings from one of the hoppers at a time.

15. The apparatus of claim 11 wherein one hopper is positioned above the other.

16. The apparatus of claim 11 wherein the vacuum means comprises a blower and an electric motor drive for powering the blower.

17. The apparatus of claim 11 wherein the upper and lower hoppers are positioned in between the vacuum means and the drill site so that each of the upper and lower hoppers define a separator for preventing the travel of solid and liquid matter to the vacuum source.

18. The apparatus of claim 11 wherein the storage tank, the holding tank, and the vacuum source are separate, transportable units.

19. The apparatus of claim 18 wherein the storage tank, the holding tank, and vacuum means are each mounted on separate transportable frames.

* * * * *